US007777640B2

(12) United States Patent
Emilsson

(10) Patent No.: US 7,777,640 B2
(45) Date of Patent: Aug. 17, 2010

(54) USE OF HEATING AND/OR VENTILATION DUCTWORK TO BROADCAST ALARM CONDITIONS

(76) Inventor: Tryggvi Emilsson, 715 W. Washington St., Champaign, IL (US) 61820

( * ) Notice: Subject to any disclaimer, the term of this patent is extended or adjusted under 35 U.S.C. 154(b) by 242 days.

(21) Appl. No.: 11/831,162

(22) Filed: Jul. 31, 2007

(65) Prior Publication Data

US 2009/0033503 A1 Feb. 5, 2009

(51) Int. Cl.
*G08B 23/00* (2006.01)

(52) U.S. Cl. ..... 340/693.5; 340/384.1; 340/691.1

(58) Field of Classification Search ..... 340/693.5, 340/693.11, 691.1, 384.1, 584, 618, 628, 340/632, 540, 541, 565–567; 381/56; 181/141, 181/175

See application file for complete search history.

(56) References Cited

U.S. PATENT DOCUMENTS

| | | | | | |
|---|---|---|---|---|---|
| 4,450,436 | A * | 5/1984 | Massa | 340/531 |
| 5,451,929 | A * | 9/1995 | Adelman et al. | 340/521 |
| 5,979,593 | A * | 11/1999 | Rice et al. | 181/207 |
| 7,445,616 | B2 * | 11/2008 | Petrakis | 604/890.1 |
| 2004/0182245 | A1 * | 9/2004 | Gorin | 96/421 |
| 2005/0083205 | A1 * | 4/2005 | Deacy | 340/628 |
| 2006/0174707 | A1 * | 8/2006 | Zhang | 73/592 |

* cited by examiner

*Primary Examiner*—Thomas J Mullen
(74) *Attorney, Agent, or Firm*—Dennis H. Rainear

(57) ABSTRACT

The present disclosure provides an audible alarm system that utilizes air-conveying ductwork to transport the audible alarm signal from the point of origination to a distant location. This system is low cost and improves the safety of individuals and reduces the potential loss of property by providing early and better hazard communication.

15 Claims, 6 Drawing Sheets

USE OF HEATING AND/OR VENTILATION DUCTWORK TO BROADCAST ALARM CONDITIONS

FIELD OF THE INVENTION

The present invention relates to an economical means of broadcasting alarm conditions that may occur in basements, utility rooms or other seldom occupied areas to the areas of residential and/or commercial premises that are more likely to be occupied. This invention uses ductwork to spread the sound of a hazard detector (e.g. smoke, heat, carbon monoxide, or flood detector) placed in a basement or utility room to other areas of the premises.

BACKGROUND OF THE INVENTION

With reference to FIG. 1, a large assortment of smoke and/or CO alarms 103 is available in any hardware store. These units are generally reliable and affordable. They often operate for a year or more on one inexpensive battery. If alarm or hazard conditions occur (for example, smoke 105, unauthorized entry or high CO concentration) they are often designed to produce a high pitched, ear piercing sound 104, loud enough to awaken most people in the immediate vicinity.

Many residential and commercial buildings are heated by forced air furnaces 101, fueled by natural gas, or oil. These units (as well as water heaters 102) are typically located in basements or utility rooms, which are quite often acoustically insulated from the rest of the premises. Malfunction of furnaces 101 and water heaters 102 are common causes of fires and/or carbon monoxide poisoning. Placing typical alarm devices 103 (as described above) in these areas offers less than desired protection, because the sound 104 is generally not effectively transmitted to dwelling areas 106. Alarm systems do exist, that feature remote sound sources, linked to the actual alarm sensors through wires, or through radio-frequency transmitters. This adds much to the cost and to the needed maintenance.

There is therefore a need for an effective and highly economical broadcasting hazard alarm system.

SUMMARY OF THE DISCLOSURE

In one embodiment of the present disclosure is provided an alarm system comprising (a) a sensor;

(b) an electronic alarm generator; and (c) a sound generating device, connectable to heating or air conditioning ductwork.

In another embodiment, the alarm has a visual display instead of a sound generating device. Such a visual display can include, for example, a flashing light for gaining the attention of the hearing impaired.

Another embodiment herein provides an alarm system comprising (a) a hazard sensor, (b) an audible sound source; and (c) a connector to connect the sound source to a heating or air conditioning ductwork system. Alternatively, the connector can be a means to couple the sound source to the ductwork.

A key feature of the present disclosure is to provide a method of improving an audible hazard alarm system having a hazard sensor, also referred to herein as a detector, and an audible sound emitting device, wherein the improvement comprises attaching the audible sound emitting device of the hazard alarm system to a heating or air conditioning system having ductwork.

It is to be understood that both the foregoing general description and the following detailed description are exemplary and explanatory only and are intended to provide further explanation of the present disclosure, as claimed.

DETAILED DESCRIPTION OF THE PRESENT DISCLOSURE

Figure 1:
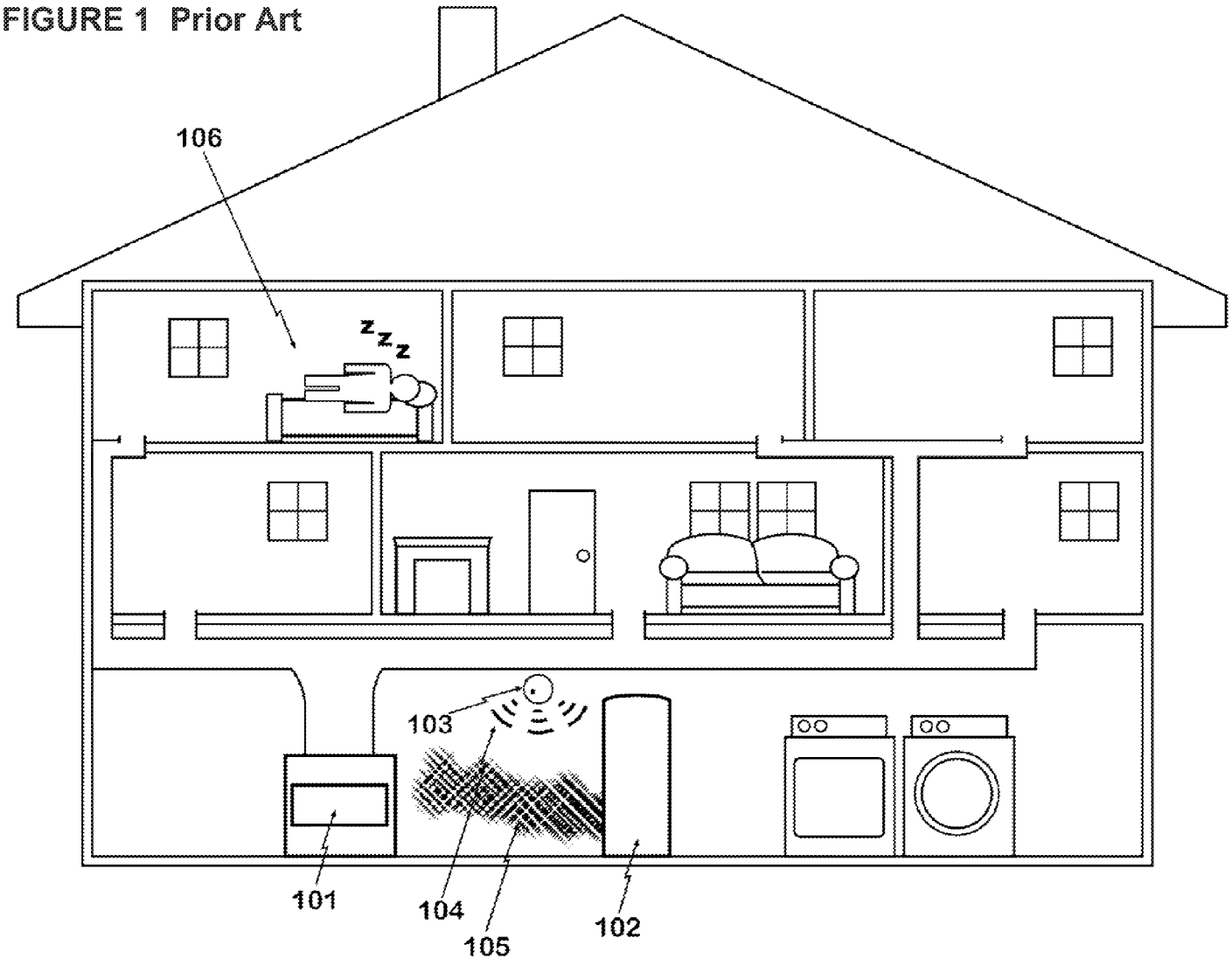
FIGURE 1 Prior Art
FIG. 1 illustrates one prior art embodiment.
Figure 2:
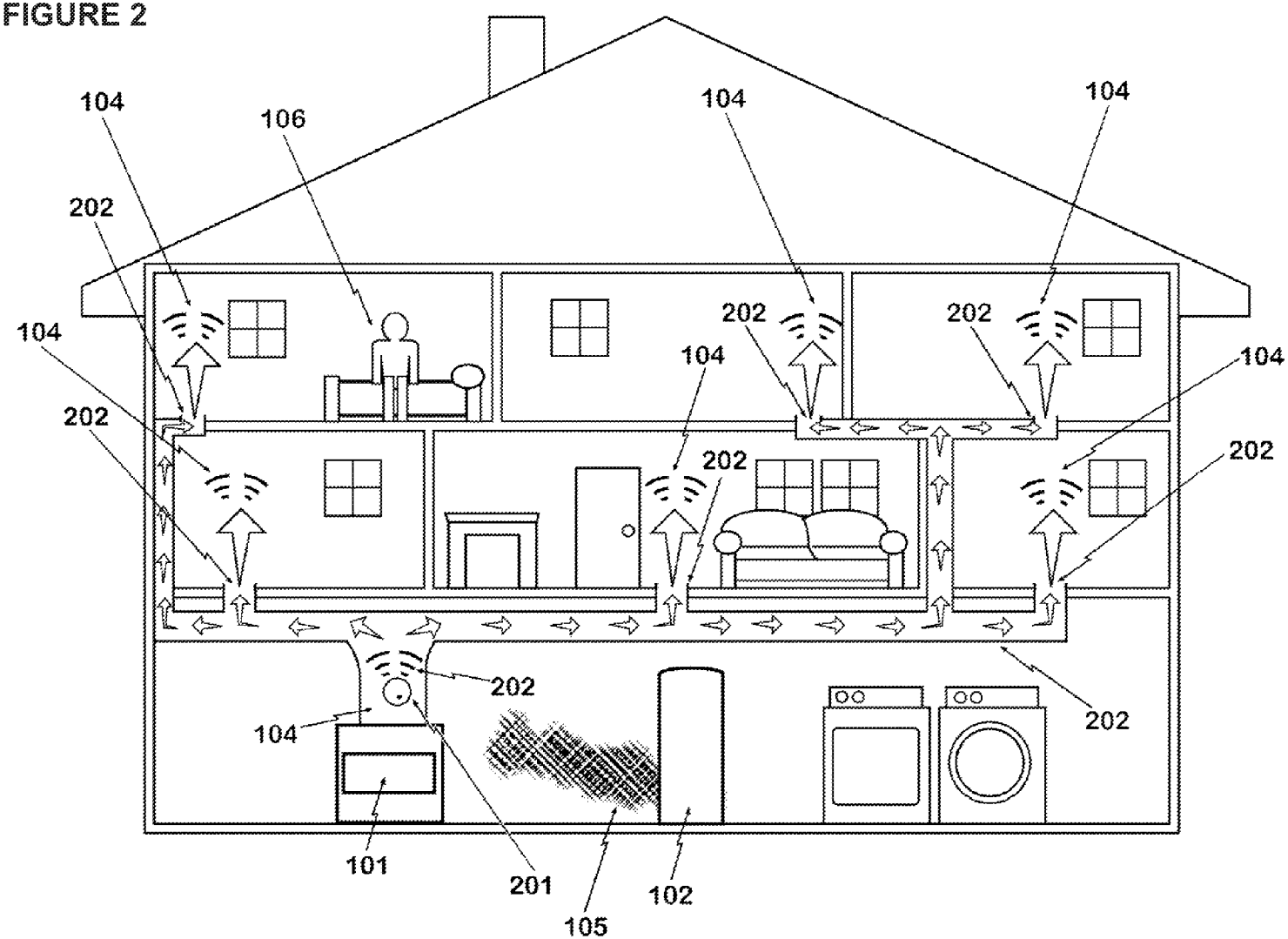
FIG. 2 illustrates one embodiment of the present disclosure.

The disclosure herein provides an alarm system able to connect to a venting or ductwork system 202 in a home or commercial building whereby an economical and inexpensive improvement is provided to the safety and hazard notification of the home or commercial building (SEE FIG. 2).

In one embodiment (SEE FIG. 2 in general, and FIG. 3 specifically), the present alarm system 201 includes a detector 301, a processor 302, an audible-sound-emitting alarm device comprising 303, and a tube 304 connecting the audible-sound-emitting alarm device comprising 303 to a ductwork system 202 capable of use for conduction of air throughout a facility.

Figure 4:
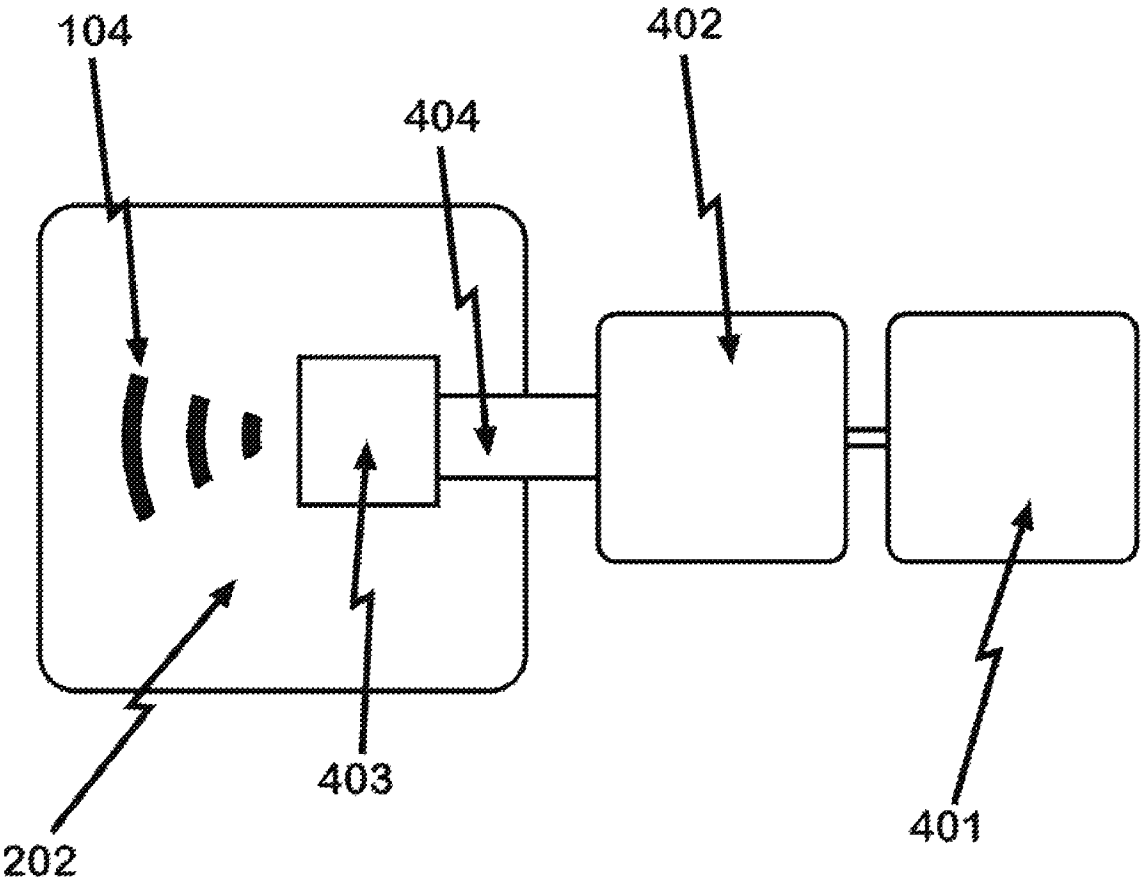
FIG. 4 illustrates another embodiment of the present disclosure.

In another embodiment of the present disclosure the sound generating device 403 is placed within the ductwork 202 (FIG. 4).

Figure 5:
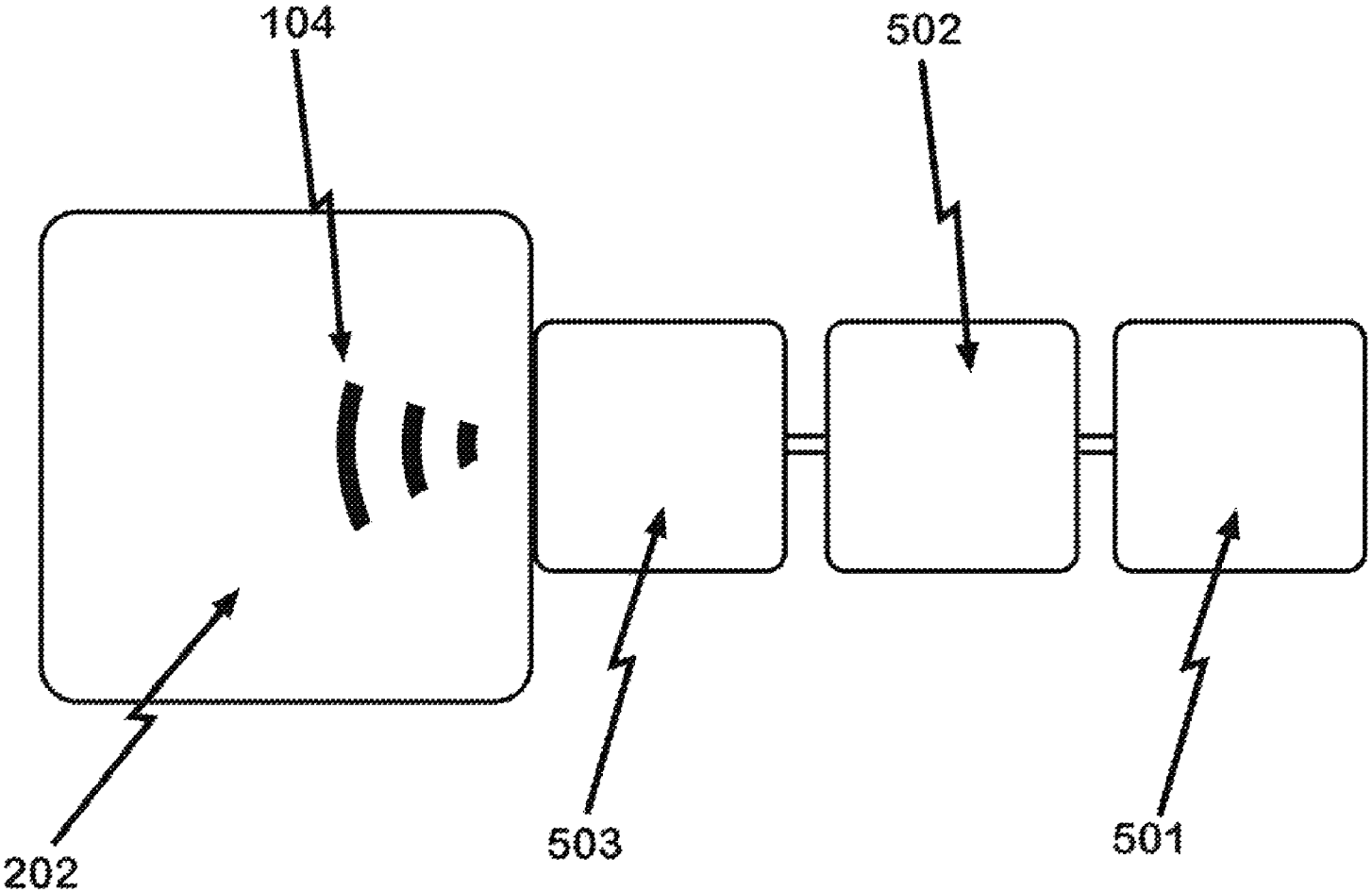
FIG. 5 illustrates another embodiment of the present disclosure.

In yet another embodiment the sound generating device 503 is attached to the outside of the wall of the ductwork 202, in such a manner that the sound vibrations 104 get coupled to the wall, which in turn produces a loud sound 104 within the duct (FIG. 5). This embodiment eliminates the need to perforate the duct wall.

Figure 6:
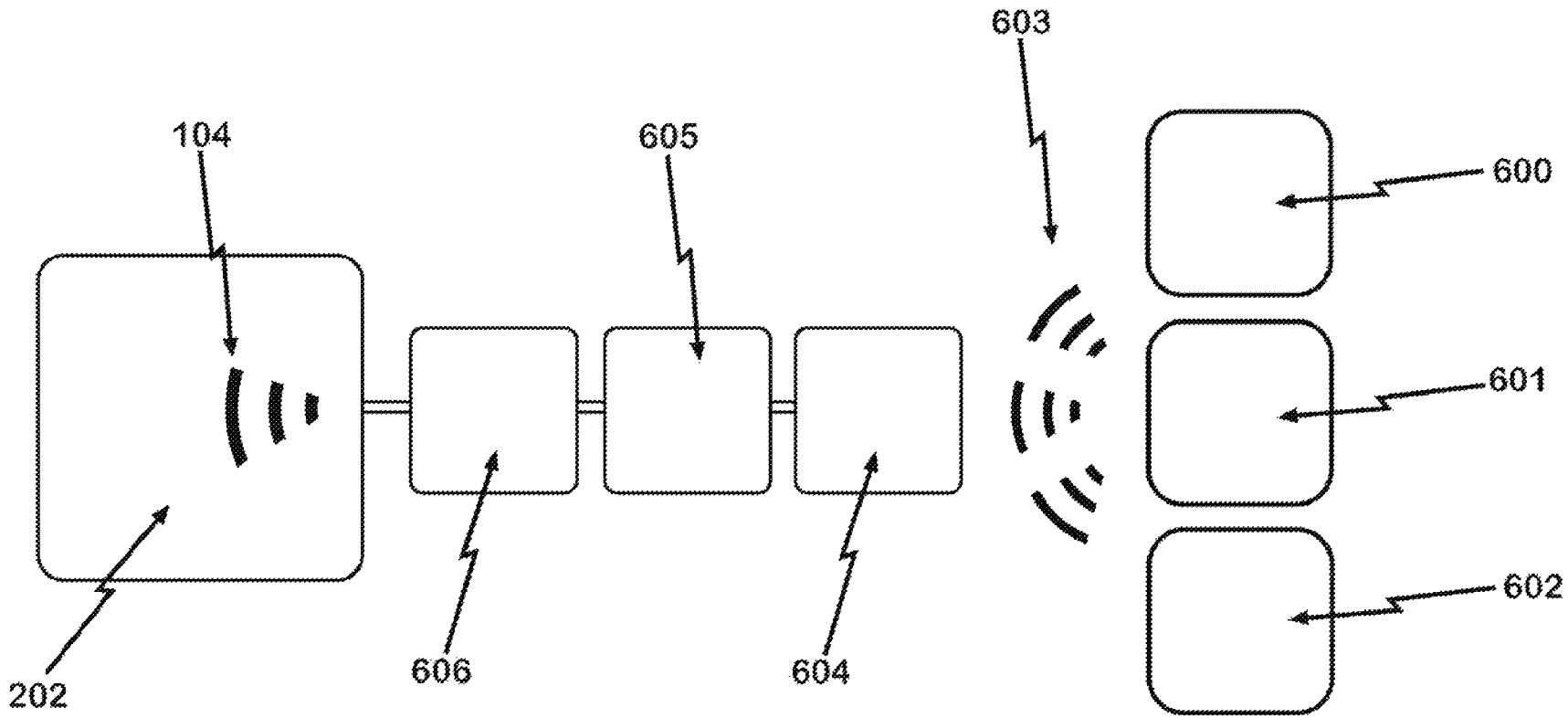
FIG. 6 illustrates another embodiment of the present disclosure.

Another embodiment provides a kit for adapting a hazard audible alarm system 201 (FIGS. 2-6) to create a facility-wide warning system through the facility's air ductworks 202. Such a kit herein can, in one embodiment (SEE FIG. 6), comprise one or more typical unmodified hazard detectors (including but not limited to smoke 600, heat, carbon monoxide 601, motion or water 602) and a device 604 which is attached to the ductwork 202 in any of the ways described above. This device 604 detects the sound 603 produced by any of the hazard detectors 601 and 602 in the vicinity, and in turn feeds it or a much louder sound 104, via components 605 and 606 as illustrated in FIG. 6, into the ductwork 202.

By "ductworks" herein is meant any and all hollow devices, hoses, tubes, vents, piping, or structures for conveying air from one location to another in a facility. The ductworks 202 can be formed of, for example and not as a limitation herein, one or more metals (such as aluminum or galvanized iron), composite board, wood, paper, paperboard, plastic or other rigid or semi-rigid materials, and combinations thereof. The ductwork 202 can in one embodiment be square or rectangular in cross-section or can be circular in the case of, for example, flexible large tubes or hoses.

Alarm systems of the various embodiments herein feed sound into existing ductwork, so that the audible alarm is heard, loudly and clearly, throughout the premises served by this ductwork. By this manner the cost and effort of installing sensors in sound-proof areas is dramatically lowered or eliminated, and this system thus has a much higher chance of saving lives and reducing property damage. The following examples further illustrate aspects of the present disclosure but do not limit the present invention.

EXAMPLES

In the following examples a 'typical alarm device" comprises:

a) a "sensor" 301, 401, 501, 604 or "detector" adapted to generate an identifiable electrical signal in response to a hazard such as ambient levels of smoke, heat, unauthorized entry or motion, carbon monoxide, water or other alarm conditions;

b) an electronic "processor" 302, 402, 502, 605 adapted to monitor the electric signal generated by the "sensor" and adapted to determine if sufficient alarm levels are present to warrant activating the sound source, and then if necessary cause the sound source to produce sound; and c) a "sound source" 303, 403, 503, 606.

Example 1

Figure 3:
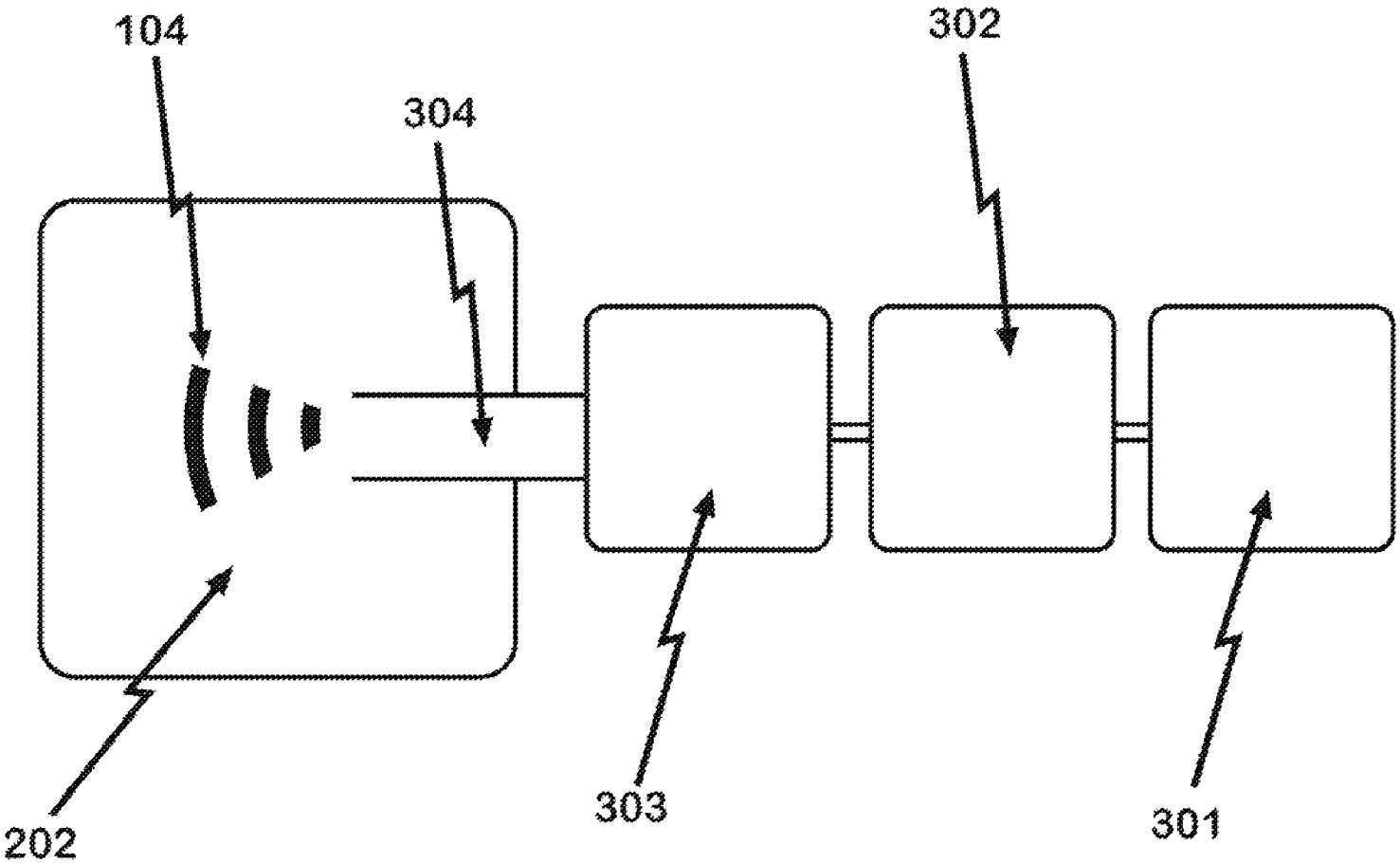
FIG. 3 illustrates another embodiment of the present disclosure.

A short tube 304 is attached to the sound source 303. This tube 304 is inserted or plugged into a hole drilled into existing ductwork 202 of a heating or air conditioning system. (FIG. 3)

Example 2

The sound source 403 is removed from a typical alarm device 401, 402, 403 and replaced with a short post 404. The sound source 403 is then attached to the end of this post 404. The post 404 and sound source 403 are then inserted into the ductwork 202, through a hole of appropriate size. (FIG. 4)

Example 3

A sound source 503 is attached on the outside of existing ductwork 202, so that the audible alarm signal is fed through the wall of the duct 202. (FIG. 5)

Example 4

A sound source 606 is attached to ductwork 202 as in any of the examples above. This device is adapted to detect sound from other hazard detectors 103, 601, 602 in the vicinity and respond by generating a loud sound into the ductwork. (FIG. 6)

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims. This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentee does not intend to dedicate any disclosed embodiments to the public, and to the extent any disclosed modifications or alterations may not literally fall within the scope of the claims, they are considered to be part of the invention under the doctrine of equivalents.

What is claimed is:

1. An alarm system comprising (a) a hazard sensor, (b) an audible sound source; and (c) a connector to acoustically connect the sound source to a heating or air conditioning ductwork system.

2. The alarm system of claim 1, wherein the sensor is able to generate a signal in response to detecting a hazard.

3. The alarm system of claim 2, further comprising an electronic processor adapted to monitor the signal from the sensor and determine if a hazard level is sufficient to activate the sound source to emit a sound.

4. The alarm system of claim 3, wherein the processor is able to receive the signal generated by the sensor and induce the sound source to generate an audible alarm in response thereto, which is heard throughout the premises served by the ductwork system.

5. The alarm system of claim 2, wherein the hazard sensors generates an audible alarm signal from said source, the alarm signal being sensed by sound sensors that then process and relay the alarm signal audibly through the ductwork system.

6. The alarm system of claim 1, wherein a hazard is selected from the group consisting of heat, smoke, carbon monoxide, motion and flood.

7. The alarm system of claim 1, wherein the connector comprises a hollow tube.

8. The alarm system of claim 1, wherein the heating or air conditioning system comprises ductwork extending at least beyond a room containing the sensor.

9. The alarm system of claim 1, wherein the heating or air conditioning system comprises ductwork extending at least beyond a room containing the sound source.

10. An alarm system comprising (a) a hazard sensor, (b) an audible sound source; and (c) a connector to connect the sound source to a heating or air conditioning ductwork system, wherein the sound source is mounted on a solid post, which protrudes into the ductwork system.

11. The alarm system of claim 10, wherein the sound source is mounted on the outside of the ductwork system and the sound is conveyed through a wall of the ductwork system.

12. A method of improving an audible hazard alarm system having a hazard sensor and an audible sound source comprising attaching said audible sound source from the hazard alarm system to a heating or air conditioning system having ductwork, and allowing audible sound from the alarm system to be acoustically conducted into the heating or air conditioning system having ductwork and conveyed therein to locations serviced by said heating or air conditioning system ductwork.

13. The method of claim 12, wherein the sound is conducted into the ductwork from the alarm system by a hollow tube.

14. The method of claim 12, wherein the sound source is mounted on a solid post, which protrudes into the ductwork.

15. A kit for adapting an alarm system to a heating or air conditioning system, said kit comprising an acoustic connector for audibly acoustically contacting the alarm system to the heating or air conditioning system.

* * * * *